United States Patent [19]

Saxne

[11] 4,140,269

[45] Feb. 20, 1979

[54] LOCKING DEVICE FOR AN AUTOMATIC SCRAPER FOR CENTRIFUGES

[75] Inventor: Ivan H. Saxne, Hässleholm, Sweden

[73] Assignee: Ingenjorsfirman Nils Weibull AB, Hässleholm, Sweden

[21] Appl. No.: 821,138

[22] Filed: Aug. 2, 1977

[51] Int. Cl.[2] ..... B04B 11/08

[52] U.S. Cl. ..... 233/3; 210/374

[58] Field of Search ..... 233/1 R, 3, 21, 22, 233/27, 46, 1 B; 210/372, 374, 375, 376

[56] References Cited

U.S. PATENT DOCUMENTS

| | | | |
|---|---|---|---|
| 2,106,964 | 2/1938 | Wells | 233/22 X |
| 2,681,152 | 6/1954 | Stindt | 210/375 |
| 2,755,991 | 7/1956 | Tholl et al. | 210/375 X |
| 3,474,905 | 10/1969 | Titus | 210/375 X |

*Primary Examiner*—George H. Krizmanich

*Attorney, Agent, or Firm*—Weingarten, Maxham & Schurgin

[57] ABSTRACT

The disclosure relates to a locking device for an automatic scraper in a centrifuge. The locking device has an automatic safety device in the form of insertable and withdrawable pins which are arranged to prevent unintentional axial movement when the scraper is in an initial position and to prevent unintentonal rotation of the scraper when it is in operative position.

8 Claims, 3 Drawing Figures

FIG.1
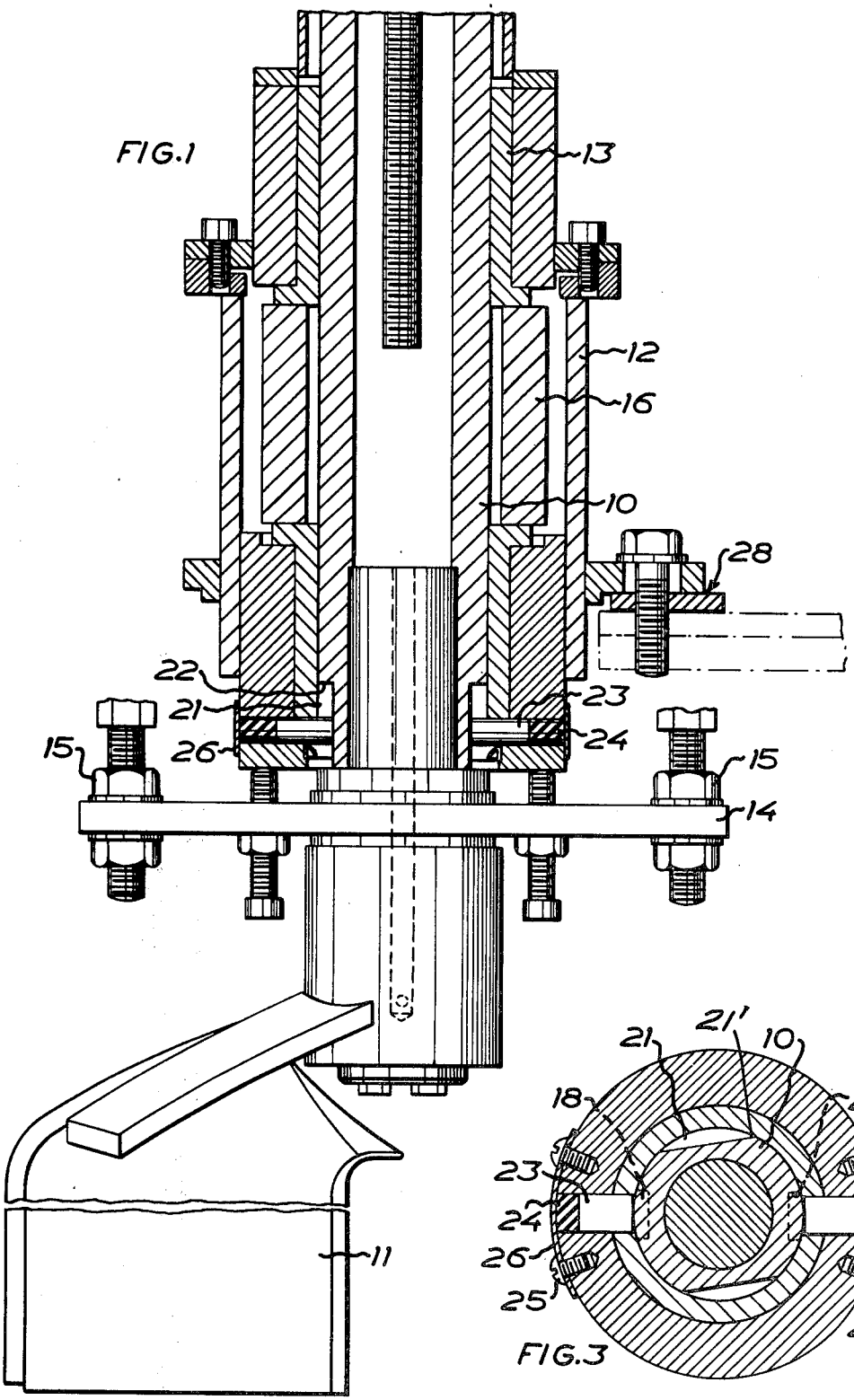
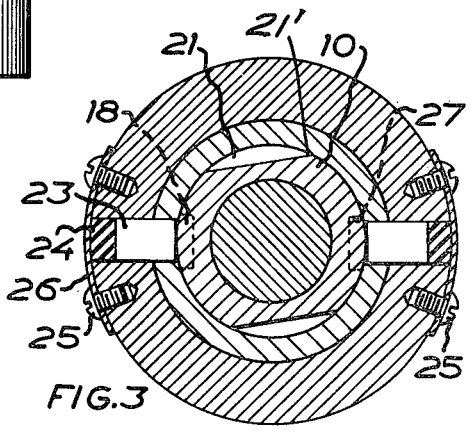
FIG.3

LOCKING DEVICE FOR AN AUTOMATIC SCRAPER FOR CENTRIFUGES

The present invention relates to a locking device for an automatic scraper for centrifuges comprising a scraper device fixedly mounted to a shaft which is rotatable and axially shiftable in bearing means for being brought into abutment with the inner wall of the centrifuge vessel and shifted along this wall.

In the emptying of centrifuge vessels, for example in sugar centrifuges, a scraper device must be pressed against the inner wall of the vessel in order that the centrifuged material adhering to the wall may be totally removed. Normally, the scraper device is fixed to a shaft which is introduced into the vessel through an opening in the upper side of the vessel and from a starting position uppermost in the vessel the scraper device is first pivoted against the wall and then shifted along the wall in a direction towards the bottom of the vessel. In the initial position, position of rest, it is important that the scraper device does not move or fall in an axial direction and, similarly, it is important, in the operative position, that the scraper device is not, while being shifted along the inner wall, rotated out of contact with the wall, since in both cases such an unintentional movement can entail extensive damage. A major aspect of the present invention is to realize a simple locking device which eliminates every risk of such undesirable movement.

According to the present invention, the shaft has at least two diametrically opposed peripheral recesses forming radial shoulders, and at least two diametrically opposed axial grooves forming axial shoulders. Moreover, at least two pins which are spring-biased towards the shaft periphery are mounted in the bearing means and, with the shaft in a first position of rotation (rest position), each project into a recess and prevent axial shaft movement and, with the shaft in a second position of rotation (operative position), each project into a groove and prevent rotational movement of the shaft.

The present invention and its aspects will be more readily understood from the following description of the accompanying drawings (which show a portion of an automatic scraper associated with a centrifuge which is not illustrated in detail) and discussion relating thereto.

In the accompanying drawings:

FIG. 1 is a longitudinal section of a portion of the scraper according to the present invention in a first position of rotation;

FIG. 3 is a section taken along the line III-III in FIG. 2.

Figure 2:
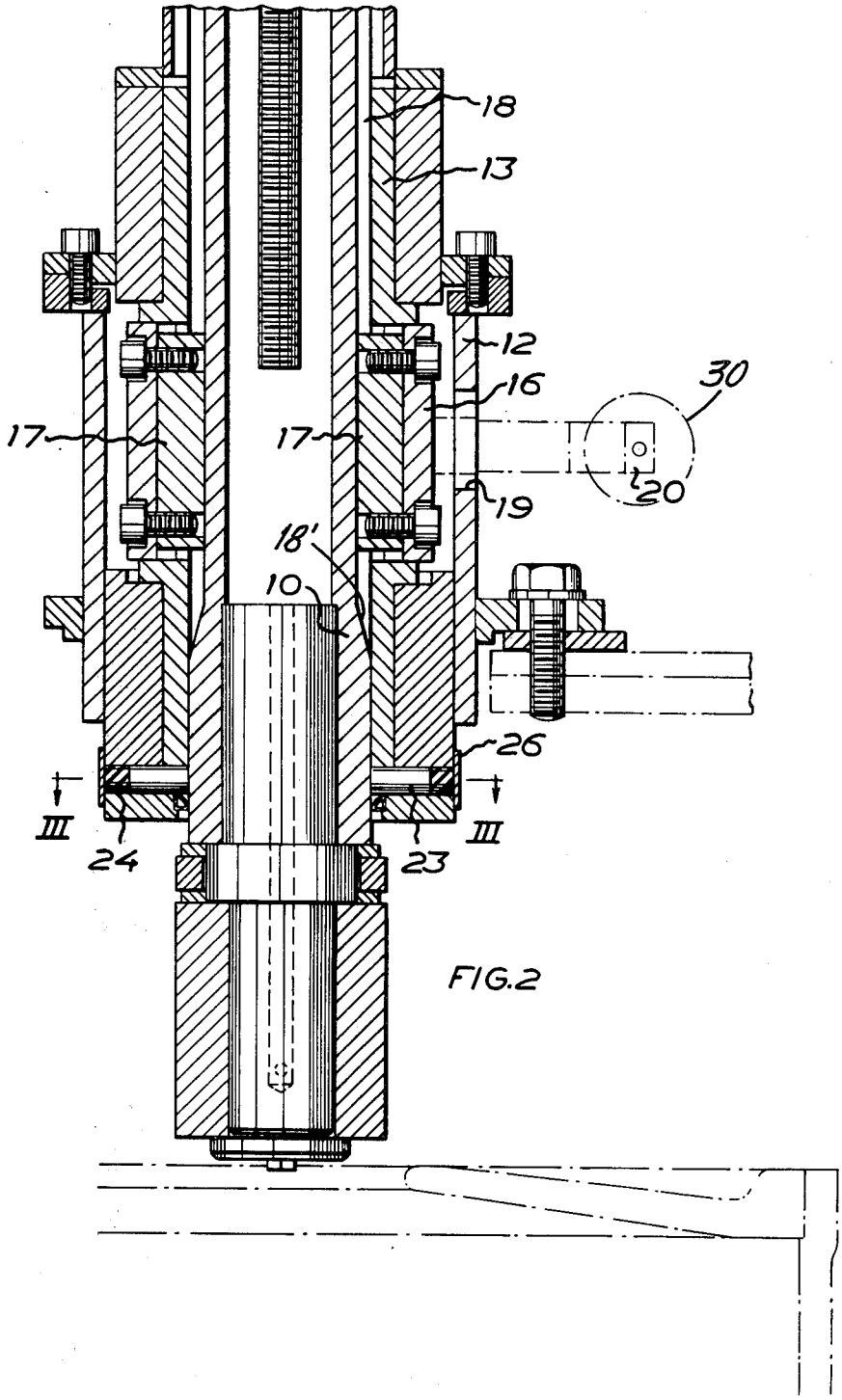
FIG. 2 shows the apparatus of FIG. 1 in a second position of rotation.

In order to avoid unnecessary complication of the presentation of this invention, the drawings do not illustrate the centrifuge which is intended to be emptied by means of the scraper device according to the present invention. Moreover, only a portion of the scraper device is illustrated, since the remainder is well known to persons skilled in the art. It is presupposed, however, that the centrifuge is provided with a conventional vessel with a central opening in its upper side, the diameter of the opening being less than the diameter of the vessel. If a scraper is inserted into the vessel it must, for scraping the inner walls of the vessel, of necessity be pivoted from its position approximately centrally in the vessel to a position adjacent the wall and then be shifted along the wall.

The scraper device shown on the drawings consists of a central shaft 10, the scraper device 11 proper being fixed to the lower end of the shaft. The shaft 10 is journaled in bearing means 12 with a lining 13, the bearing means being supported by a frame portion as shown at 28. The shaft 10 is axially shiftable in the bearing means 12, 13 by means of cylinders (not shown) which are connected to a shifting member 14 by means of nut and bolt assemblies 15, the shifting member 14 being non-shiftably but rotatably connected to the shaft in the vicinity of the end of the shaft provided with the scraper 11. In the bearing means 12, 13, an entrainer ring 16 is disposed around the shaft 10 and has, on two diametrically opposed locations, wedges 17 fixed by means of bolts. The shaft 10 has two grooves 18, as shown in FIGS. 2 and 3, which are located diametrically opposite one another on the shaft. Grooves 18 extend longitudinally along the major part of the length of the shaft from a point spaced from scraper device 11 to the opposite end of the shaft. At the point spaced from scraper device 11, the grooves 18 merge with the full diameter of the shaft by means of an intermediate inclined plane or ramp portion 18'. Wedges 17 engage grooves 18. The shaft 10 may be rotated in the bearing means 12, 13 by turning the ring 16 with the wedges in engagement with the grooves 18. Ring 16 is turned by means of an arm 20 affixed to the ring 16 and passing through an opening 19 in the bearing housing. The arm 20 is coupled to a piston and cylinder assembly shown schematically and indicated by reference numeral 30, which causes the arm to rotate about the shaft in a plane perpendicular thereto. It will thus be apparent that the shaft 10 can be shifted axially in the bearing means 12, 13 by the cylinders (not shown) via the parts 15 and 14, and can be rotated in the bearing means 12, 13 via the arm 20 and the parts 16, 17.

Two recesses 21 are provided in the lower end of the shaft 10 (the end facing the scraper device 11), these recesses being, in accordance with FIG. 3, provided in that two opposing circle-segment-shaped portions have been removed from the shaft section. Thus, the inner surfaces of recesses 24 are in the form of a chord with respect to the circle of the outer diameter of the shaft, and the transition from recess to outer surface is represented by reference numeral 21' in FIG. 3. As is apparent from FIG. 1, a shoulder 22 is formed as a result of each recess 21 at the end thereof facing away from the shaft end provided with the scraper device. The previously-described grooves 18 extend from the opposite end of the shaft 10 and, as is shown in FIG. 3, are substantially rectangular for forming axially shoulders 27. The grooves 18 terminate, as is apparent from FIG. 2, an axial distance from the end of the recesses facing away from the scraper device. The bearing means 12, 13 has two diametrically opposed holes in the vicinity of the shaft end provided with the scraper device 11. These holes each accomodate a pin 23 and a spring 24 in the form of a rubber block. As is apparent from FIG. 3, a retainer plate 26, fixedly disposed on the outer side of the bearing means by screws 25 is provided for retaining the pin 23 and spring 24 in their associated hole. The springs 24 are received between the end of the pins 23 facing away from the shaft 10 and the associated retainer plate 26 and serve to bias the pins 23 out of their bores and into either the recesses 21 or the grooves 18, depending upon the longitudinal position of the shaft.

In FIG. 1, it is taken that the scraper device is located in a predetermined position of rotation or position of rest approximately in the middle of the centrifuge vessel. In this instance it is, as was mentioned by way of introduction, of extreme importance that the shaft does not move unintentionally or fall vertically, for example because of the absence of pressure medium to the piston and cylinder assemblies regulating the movement of the shaft. For this reason, the recesses 21 are located, in this position of rotation, in register with the pins 23 which, by means of their associated springs 24, are pressed towards the shaft in the manner illustrated in FIG. 1. Consequently, in the event of pressure medium loss, the shaft 10 will not move further than to the position where the shoulders 22 abut against the pins 23, and no damage can thereby occur. When a scraping operation is to be carried out, the shaft 10 is first turned from the position shown in FIG. 1 by means of the piston and cylinder assembly which acts on the ring 16 via the arm 20 a predetermined angle, according to FIG. 3 something over 90°. As a result, the scraper device 11 is brought to a position adjacent the wall of the centrifuge vessel. During the rotation of the shaft 10, the pins 23 move in relation to their grooves 21 and approach one edge 21' of the groove. As it appears in FIG. 3, the apparent depth of the grooves 21 is reduced, with respect to any point stationary in relation to the shaft, during the rotation of the shaft 10. Therefore, the pins 23, following the surfaces of the grooves, retreat away from the shaft axis into the bores against the bias of springs 24. When pins 23 reach the edge 21' of the grooves, they have also reached the nominal diameter of the shaft and the pins can then run up onto the peripheral surface of shaft 10. When the rotary movement of the shaft ceases, the pins reside in the position shown in FIG. 3 between recesses 21. When the shaft has been turned to the position shown in FIG. 3, pins 23 are located directly beneath the axial grooves 18, which grooves merge with the nominal diameter of shaft 10 along an inclined plane 18'. The piston and cylinder assembly 30 engaging with the arm 20 is then deactivated and the piston and cylinder assemblies engaging with the shaft via the parts 14 and 15 are activated and the scraper device commences to be shifted axially. As the shaft 10 is moved axially downward a short distance, each of the pins 23 will penetrate, via the inclined plane 18', into a groove 18, thereby preventing further rotation of the shaft. As a result, the shaft 10 cannot leave its position adjacent the wall of the vessel even if loss of pressure were to occur. After the scraping operation, when the shaft 10 is raised, the pins 23 will slide out of their grooves 18 via the inclined plane 18' and stop in the position shown in FIG. 3 on the nominal diameter of the shaft. In this condition, the shaft can again be rotated, since the pins 23 are no longer in the grooves 18. After partial rotation as described above and as shown in FIG. 1, the pins 23 once again project into the recesses 21 for preventing axial movement of the shaft 10 with the scraper device 11.

Naturally, more than two recesses 21, grooves 18 and pins 23 may be provided if necessary. Similarly, the scraper device need not necessarily be regulated by means of piston and cylinder assemblies, it being possible to realize the movements in question by conventional mechanical devices. The illustrated and described locking apparatus with the pins 23 and springs 24 is extremely simple to mount into an extant scraper device and functions in a highly satisfactory manner.

What I claim and desire to secure by Letters Patent is:

1. In a centrifuge having an inner wall, a locking device for an automatic scraper, said locking device comprising: bearing means mounted to said scraper; a shaft rotatable and axially shiftable in said bearing means; a scraper device secured to said shaft and adapted to be brought into abutment with the inner wall of the centrifuge vessel and to be shifted along said wall; said shaft having at least two diametrically opposed peripheral recesses forming radial shoulders and at least two diametrically opposed axial grooves forming axial shoulders; and at least two pins spring-biased towards the shaft periphery mounted in said bearing means; wherein with the shaft in a rest position and in a first position of rotation, each said pin projects into a said recess and prevents axial shaft movement, and with the shaft in an operative position and in a second position of rotation, each said pin projects into a groove and prevents rotational movement of said shaft.

2. The locking device as set forth in claim 1 wherein said recesses extend from the end of said shaft facing said scraper device, and wherein said grooves extend from the opposite end of said shaft facing away from said scraper device, said grooves terminating at an axial distance from said recesses.

3. The locking device as set forth in claim 1, wherein said springs consist of rubber blocks.

4. The locking device as set forth in claim 1 and further comprising means for rotating said shaft in said bearing means, said rotating means also engaging said grooves.

5. The locking device as set forth in claim 2 wherein each of said springs comprises rubber blocks.

6. The locking device as set forth in claim 2 and further comprising means for rotating said shaft in said bearing means, said rotating means also engaging said grooves.

7. The locking device as set forth in claim 3 and further comprising means for rotating said shaft in said bearing means, said rotating means also engaging said grooves.

8. The locking device as set forth in claim 5 and further comprising means for rotating said shaft in said bearing means, said rotating means also engaging said grooves.

* * * * *